US008875538B2

(12) United States Patent
Lee et al.

(10) Patent No.: US 8,875,538 B2
(45) Date of Patent: Nov. 4, 2014

(54) REFRIGERATOR

(75) Inventors: Su-Won Lee, Gyeongsangnam-do (KR); Hee Uhk Park, Gyeongsangnam-do (KR); Sung-Eun Kim, Gyeongsangnam-do (KR)

(73) Assignee: LG Electronics Inc., Seoul (KR)

( * ) Notice: Subject to any disclaimer, the term of this patent is extended or adjusted under 35 U.S.C. 154(b) by 505 days.

(21) Appl. No.: 13/266,154

(22) PCT Filed: Sep. 3, 2009

(86) PCT No.: PCT/KR2009/004966

§ 371 (c)(1),
(2), (4) Date: Oct. 25, 2011

(87) PCT Pub. No.: WO2010/131812

PCT Pub. Date: Nov. 18, 2010

(65) Prior Publication Data

US 2012/0103002 A1 May 3, 2012

(30) Foreign Application Priority Data

May 12, 2009 (KR) ..... 10-2009-0041167

(51) Int. Cl.

| | |
|---|---|
| ***B67D 5/02*** | (2006.01) |
| ***F25D 23/12*** | (2006.01) |
| ***F25D 23/02*** | (2006.01) |
| *F25C 5/00* | (2006.01) |

(52) U.S. Cl.

CPC ..... *F25D 23/12* (2013.01); *F25D 23/02* (2013.01); *F25D 23/021* (2013.01); *F25D 2323/023* (2013.01); *F25C 5/005* (2013.01)

USPC ..... 62/389

(58) Field of Classification Search

CPC .... F25D 23/021; F25D 2323/023; B67D 5/02

USPC ..... 62/66, 344, 389, 449

See application file for complete search history.

(56) References Cited

U.S. PATENT DOCUMENTS

| | | | | |
|---|---|---|---|---|
| 3,572,053 | A * | 3/1971 | Jacobus et al. | 62/344 |
| 3,602,007 | A * | 8/1971 | Drieci | 62/344 |
| 3,747,363 | A * | 7/1973 | Grimm | 62/377 |
| 4,209,999 | A * | 7/1980 | Falk et al. | 62/344 |
| 4,306,757 | A * | 12/1981 | Horvay et al. | 312/292 |
| 7,059,693 | B2 * | 6/2006 | Park | 312/405.1 |
| 7,318,633 | B2 * | 1/2008 | Shin et al. | 312/405 |
| 7,958,742 | B2 * | 6/2011 | Park et al. | 62/389 |

(Continued)

FOREIGN PATENT DOCUMENTS

| | | | |
|---|---|---|---|
| CN | 101283229 | A | 10/2008 |
| KR | 10-2004-0085756 | A | 10/2004 |

(Continued)

OTHER PUBLICATIONS

PCT International Search Report dated Apr. 19, 2010 for Application No. PCT/KR2009/004966, with English translation, 4 pages.

(Continued)

*Primary Examiner* — Mohammad M Ali
*Assistant Examiner* — Emmanuel Duke
(74) *Attorney, Agent, or Firm* — Fish & Richardson P.C.

(57) ABSTRACT

The embodiment relates to a refrigerator. A dispenser is not exposed to the outside when the dispenser is not used, such that the design of the refrigerator can be upgraded and the injection of foreign materials into the dispenser is blocked, such that sanitary conditions can be improved.

7 Claims, 9 Drawing Sheets

(56) References Cited

U.S. PATENT DOCUMENTS

| | | | | |
|---|---|---|---|---|
| 2004/0148958 | A1* | 8/2004 | Park | 62/381 |
| 2008/0120987 | A1 | 5/2008 | Park et al. | |
| 2008/0314065 | A1* | 12/2008 | Kim | 62/389 |
| 2009/0007585 | A1* | 1/2009 | Kim et al. | 62/353 |
| 2009/0095010 | A1 | 4/2009 | Moon | |
| 2010/0072870 | A1 | 3/2010 | Hwang | |

FOREIGN PATENT DOCUMENTS

| | | | | |
|---|---|---|---|---|
| KR | 1020040085756 | * | 10/2004 | F25D 25/00 |
| KR | 10-2008-0036810 | A | 4/2008 | |
| KR | 1020080036810 | * | 4/2008 | F25D 25/00 |
| KR | 10-2008-0046848 | A | 5/2008 | |
| KR | 1020080046848 | * | 5/2008 | F25D 25/00 |

OTHER PUBLICATIONS

Chinese Office Action dated Aug. 1, 2013 for Application No. 200980158763.6, with English Translation, 17 pages.

Chinese Office Action dated Feb. 7, 2013, for Application No. 200980158763.6, with English Translation, 13 pages.

* cited by examiner

REFRIGERATOR

CROSS REFERENCES RELATED APPLICATIONS

The present application claims benefits of priority to Korean Patent Application No. 10-2009-0041167 (filed on May 12, 2009), which is hereby incorporated by reference in its entirety.

BACKGROUND OF THE INVENTION

1. Field of the Invention

The embodiment relates to a refrigerator.

2. Description of the Related Art

Generally, a refrigerator is home appliance that stores foods in a refrigerating or freezing state. The refrigerator is home appliance that drives a freezing cycle by electronic parts included therein and cools a storage space therein by directly/indirectly using a cool air generated by the freezing cycle.

Many efforts to develop technologies for a large-sized and multi-functional refrigerator have been made in recent. Further, many investments have been made to improve a design of a refrigerator. Many users are tending to prefer products wherein an external appearance of a refrigerator is gracefully designed. In particular, the users are tending to prefer products that the front surface of the refrigerator is smoothly treated and a border line between doors is not exposed. For this reason, a refrigerator wherein doors separately provided to be protruded at the front surface of the doors are removed and the handle portion is exposed to the outside is being launched in the market.

A need exists for a refrigerator in which a dispenser structure for dispensing water/ice, which is provided at the front surface of the refrigerator, is not exposed to the outside, according to the consumer preference.

SUMMARY OF THE INVENTION

The present invention proposes to achieve the above object. It is an object of the present invention to provide a refrigerator in which a dispenser structure is provided at the front surface of a refrigerator door and is not exposed to the outside when the dispenser structure is not used.

To achieve the above object, there is provided a refrigerator according to an embodiment of the present invention, including: a storage chamber that is maintained at temperature lower than external temperature; a storage chamber door that selectively opens and closes the storage chamber; and a dispenser assembly that is provided at the storage chamber door, wherein the dispenser assembly includes: a housing that is depressed to receive a container and has an opening part formed at the front surface thereof; a dispenser door that is rotatably provided at the front surface of the housing and is rotated into the housing to open the opening part; and a dispensing part that is provided at a predetermined surface of the housing to dispense water or ice.

There is provided a refrigerator according to another embodiment of the present invention, including: a main body including a storage chamber; a storage chamber door that selectively opens and closes the storage chamber; and a dispenser assembly that is provided at the storage chamber door, wherein the dispenser assembly includes: a housing that is depressed to receive a container and has an opening part formed at the front surface thereof; a dispenser door that selectively opens and closes the opening part; a dispensing part that is provided at a predetermined surface of the housing to dispense water or ice wherein the front surface of the dispenser door and the front surface of the storage chamber door become coplanar in a state where the dispenser door shields the opening part.

With the refrigerator having the above-mentioned configuration according to the embodiment of the present invention, the dispenser is not exposed to the outside when the dispenser provided at the refrigerator door is not used, such that the front surface of the refrigerator door forms a single smooth surface, making it possible to make the external appearance of the refrigerator graceful.

In addition, the dispenser is shielded by the dispenser door in the state where the dispenser is not used, such that the injection of foreign materials into the dispenser can be prevented, making it possible to keep the dispenser clean.

DETAILED DESCRIPTION OF THE PREFERRED EMBODIMENTS

Hereinafter, embodiments of the present invention will be described in detail with reference to the accompanying drawings. The spirit of the present invention is not limited to the following embodiments and the accompanying drawings. However, it is noted that the present invention is limited only by the appended claims corresponding to the right scope of the present invention.

Figure 1:
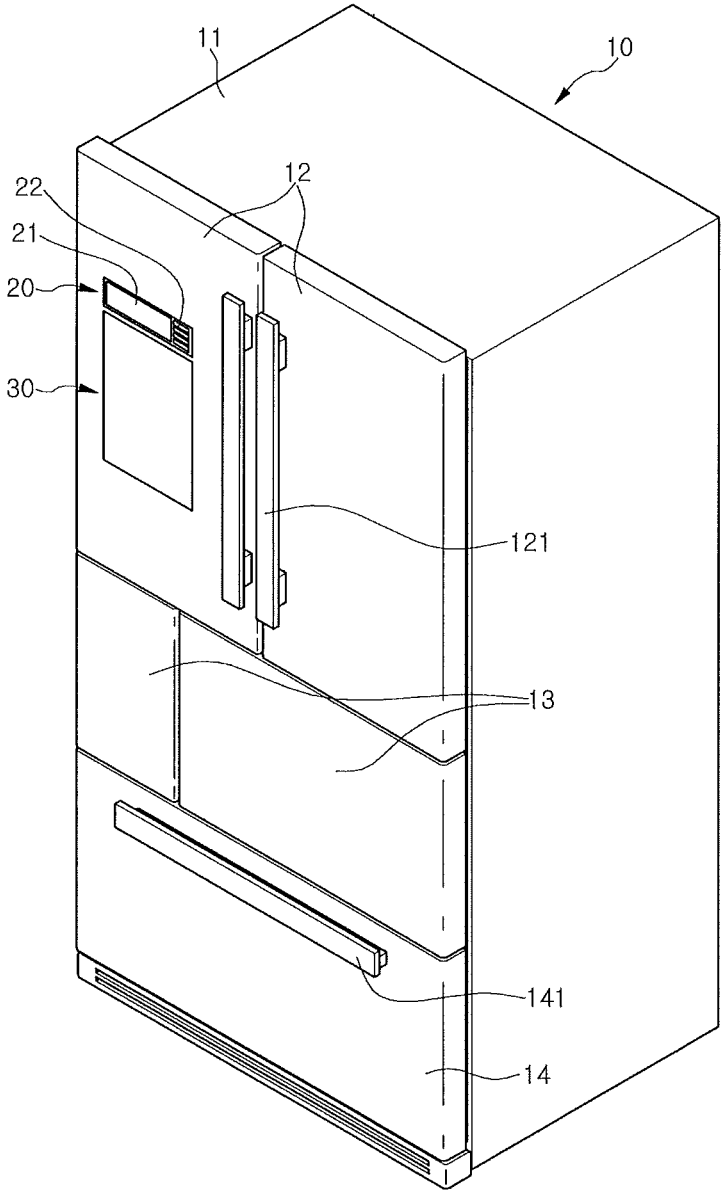
FIG. 1 is an exterior perspective view of a refrigerator according to a first embodiment of the present invention and is a diagram showing a state where a dispenser function is not used.
Figure 2:
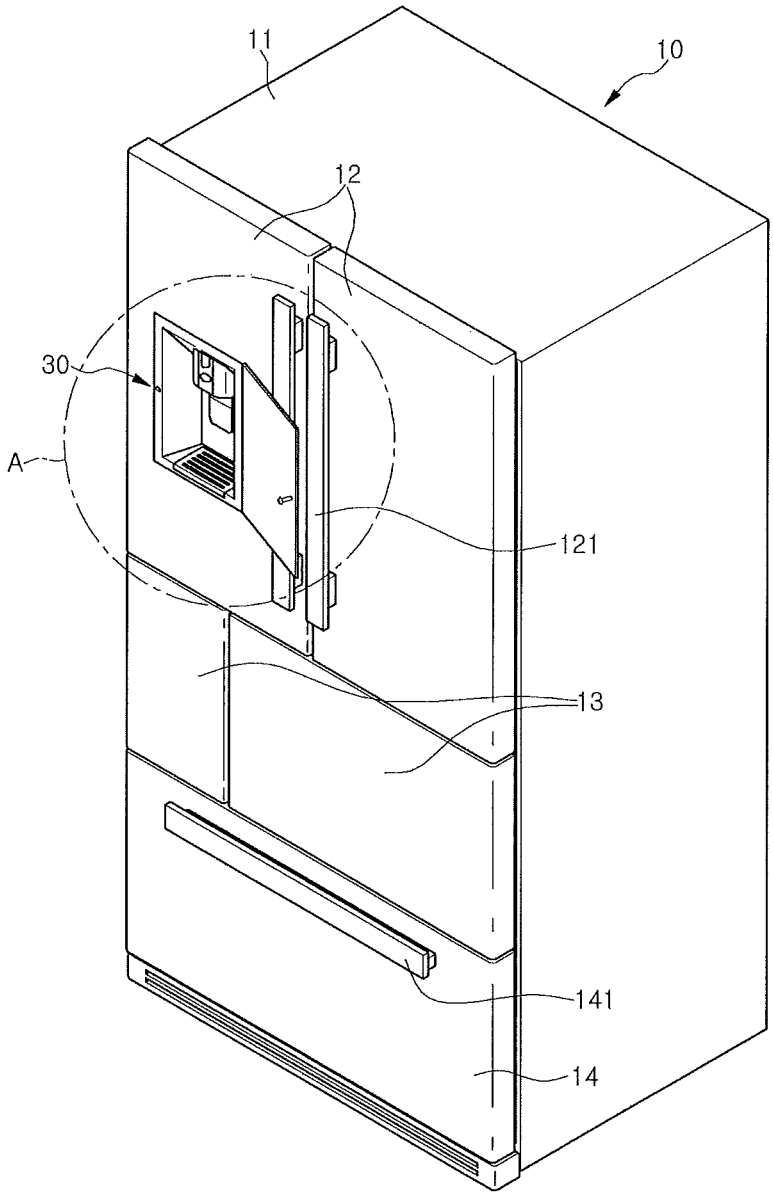
FIG. 2 is an exterior perspective view of a refrigerator according to a first embodiment of the present invention and is a diagram showing a state where a dispenser function is used.
Figure 3:
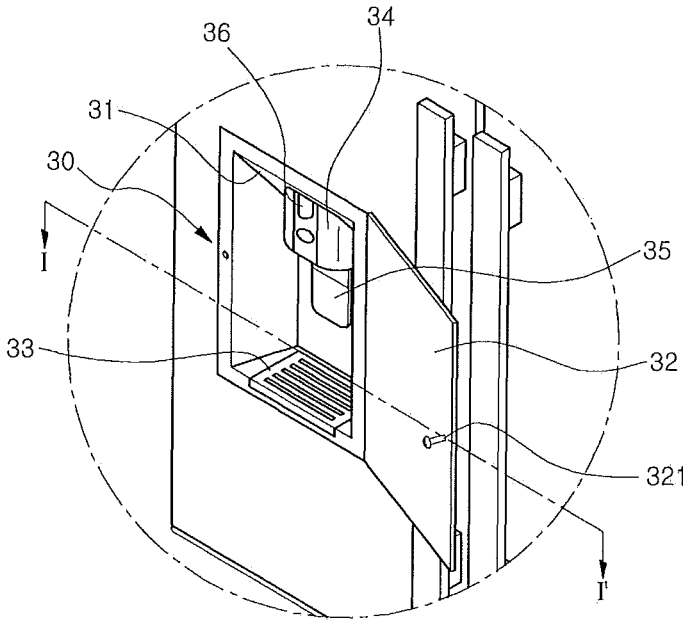
FIG. 3 is an enlarged perspective view of A portion of FIG. 2 and is a diagram showing a dispenser assembly according to the embodiment of the present invention.

FIG. 1 is an exterior perspective view of a refrigerator according to a first embodiment of the present invention and is a diagram showing a state where a dispenser function is not used, FIG. 2 is an exterior perspective view of a refrigerator according to a first embodiment of the present invention and is a diagram showing a state where a dispenser function is used, and FIG. 3 is an enlarged perspective view of A portion of FIG. 2 and is a diagram showing a dispenser assembly according to the embodiment of the present invention.

Referring to FIGS. 1 to 3, the refrigerator 10 according to an embodiment of the present invention includes the main body 11 having a storage space provided therein, the door for selectively opening and closing the storage space, and the freezing cycle.

In detail, the freezing cycle includes a compressor, a condenser, an expander, and an evaporator. A portion of the freezing cycle is received in a machine room included in the main body 11.

It is noted that the embodiment describes, by way of example, a case where a refrigerating chamber door is five but is not limited thereto.

In more detail, in the embodiment, the door may include a pair of upper doors 12 that opens and closes the storage chamber provided at a relatively upper side of the main body 11, a middle door 13 that opens and closes the storage chamber provided at a lower side of the storage chamber opened and closed by the upper door 12, and a lower door 14 that opens and closes the storage chamber provided at a lower side of the storage chamber opened and closed by the middle door 13. Each door may be provided with handles 121 and 141.

In addition, the upper door 12 may be french doors that are rotatably connected with edges of both sides of the main body 11 and the storage chamber, which is selectively opened and closed by the upper door 12, may be a refrigerating chamber having a single space.

Further, the middle door 13 may be proved in a rotating type or a drawing type and the storage chamber, which is opened and closed by the middle door 13, may be a refrigerating chamber or a freezing chamber.

Moreover, the lower door 14 may be proved in a rotating type or a drawing type and the storage chamber, which is opened and closed by the lower door 14, may be a freezing chamber.

Also, any one of the pair of upper doors 12 may be provided with a display unit 20. The display unit 20 may include at least a screen unit 21 that confirms an operation state of the refrigerator and outputs images and a button unit 22 that dispenses ice and water or inputs instructions for opening and closing a dispenser door to be described below.

Moreover, a lower side of the display unit 20 is provided with a dispenser assembly 30 that dispenses water or ice. A rear surface of the upper door 12, which is provided with the dispenser assembly 30, is mounted with an ice making assembly, making it possible to dispense ice, which is made and stored in the ice making assembly, through a dispenser assembly 30. Herein, the ice making assembly is mounted inside the storage chamber that is opened and closed by the upper door 12 and the rear surface of the upper door 12 may be provided with a discharge duct structure that guides the ice dispensing.

Meanwhile, the dispenser assembly 30 includes a housing 31 that is depressed backward at a predetermined depth and can receive a container, an ice chute 34 that is extended downward from the upper surface of the housing 31, an ice chute 34 that guides the ice dispensing, a faucet 36 that is protruded downward from the front of the ice chute and dispenses water, a dispensing button 35 that is extended from the rear surface of the housing 31 and is pressed to a container such as a cup to dispense water or ice, a tray 33 that is removably provided at the bottom surface of the housing 30 and stores residual water, and a dispenser door 32 that is rotatably provided at the front surface of the housing 31 and selectively shields the internal structure of the housing 31.

In detail, a locker 321 is protruded at the edge of the rear surface of the dispenser door 32, such that the dispenser door 32 can be inserted into the front surface of the housing 31. The dispenser door 32 has a structure that left and right edges of the dispenser door 32 are rotatably connected with the housing 31, but is not limited thereto. In other words, a rotation central shaft of the dispenser door 32 may be formed at the upper end portion or the lower end portion.

Figure 4:
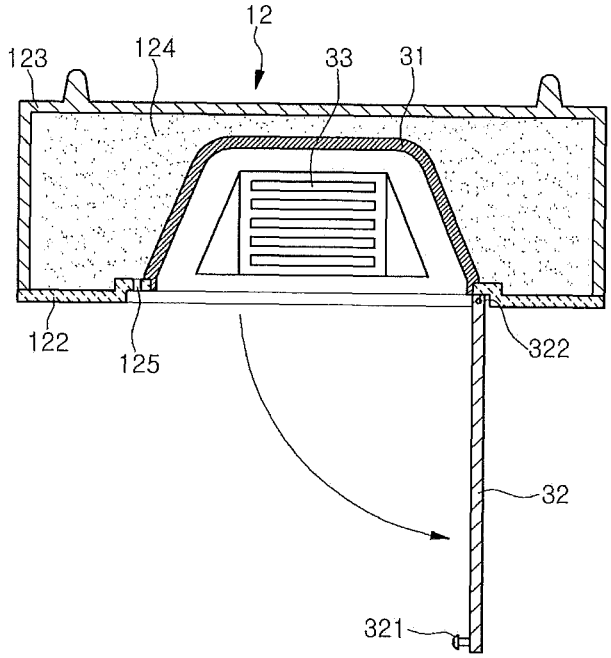
FIG. 4 is a transverse cross-sectional view taken along line I-I' of FIG. 3.

FIG. 4 is a transverse cross-sectional view taken along line I-I' of FIG. 3.

Referring to FIG. 4, the upper door 12 includes a door cover 122 that forms a front external appearance, a door liner 123 that is attached to the rear surface of the door cover 122, and an insulating layer 124 that is filled between the door cover 122 and the door liner 123. The housing 31 of the dispenser assembly 30 is depressed at a predetermined depth between the door cover 122 and the door liner 123. A connection portion of the door cover 122 and the housing 31 is formed with a locking hole 125 into which the locker 321 is inserted. The locking hole 125 is formed at a front edge portion of the housing 31 or may be formed on the door cover 122. The locker 321 may be a switch that is inserted into the locking hole 125 by a pressing and releasing action onto the dispenser door 32 or is out of the locking hole 125.

In detail, the switch structure applied to the structure of the locker 321 and the locking hole 125 has been frequently applied to the existing refrigerator home bar door. In other words, the switch structure means a structure that the locker 321 is maintained at the state of being inserted into the locking hole 125 when the dispenser door 32 is closed and the locker 321 is out of the locking hole 125 to open the dispenser door 32 by a pressing and releasing action onto the dispenser door 32 in the state where the dispenser door 32 is closed. In order to apply the function to the dispenser door 32, the rotating shaft 322 of the dispenser door 32 should be mounted a torsion spring or a hydraulic damper that generates predetermined repulsive force or elastic force to the rotating shaft 322 of the dispenser door 32.

Further, the button unit 22 of the display unit 20 may be separately provided with the input button that inputs instructions to automatically open and close the dispenser door 32.

Figure 5:
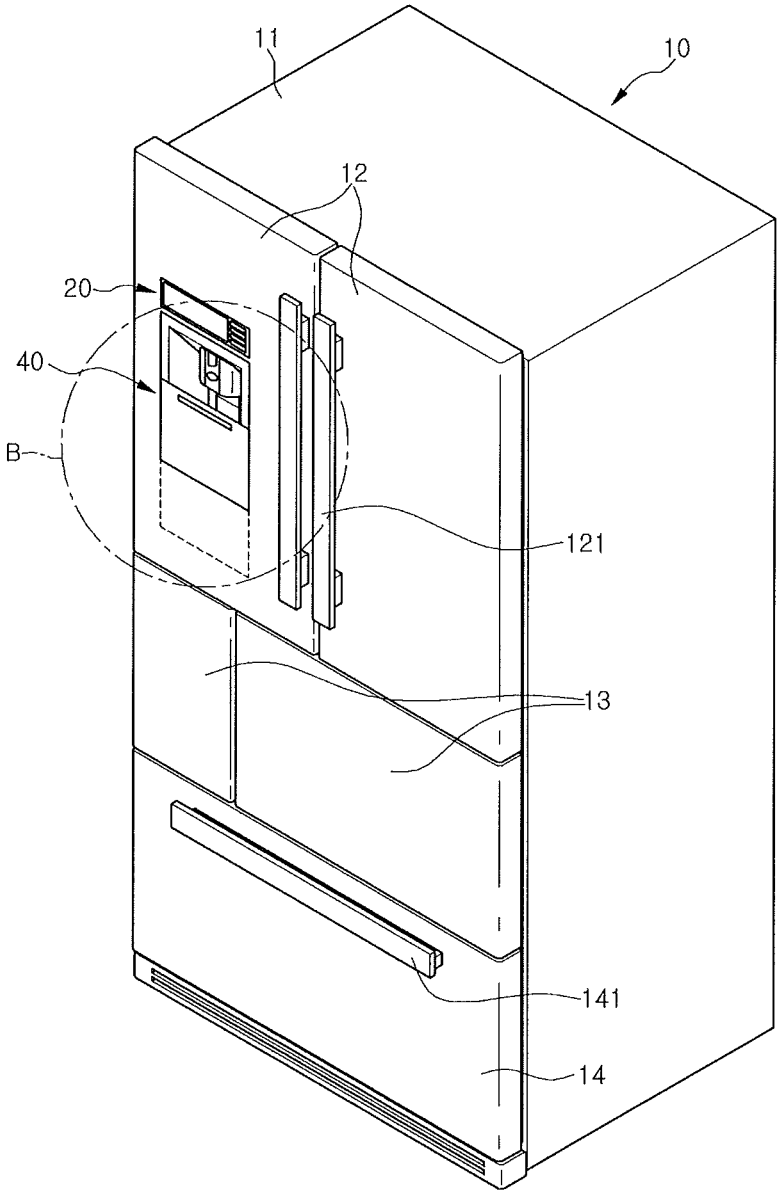
FIG. 5 is a perspective view of a refrigerator according to a second embodiment of the present invention.
Figure 6:
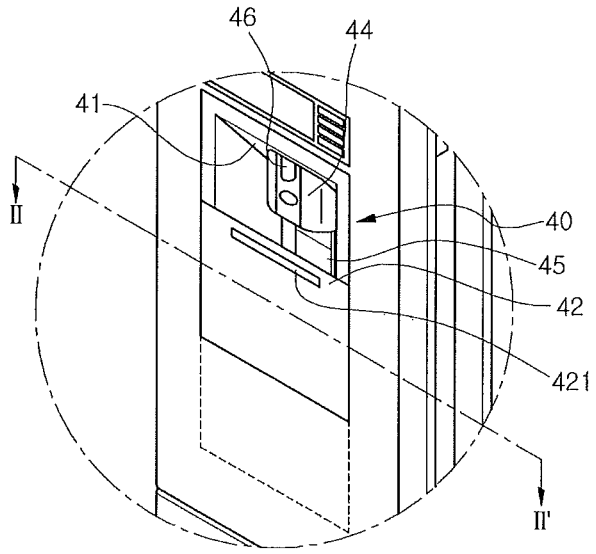
FIG. 6 is an enlarged perspective view of B portion of FIG. 5.

FIG. 5 is a perspective view of a refrigerator according to a second embodiment of the present invention and FIG. 6 is an enlarged perspective view of a B portion of FIG. 5.

In the refrigerator 10 according to the second embodiment of the present invention, the description of the configuration having the same reference numerals as the first embodiment will be omitted. The dispenser assembly 40 includes a housing 41, an ice chute 44, a faucet 46, and a dispensing button 45, likewise the first embodiment.

Referring to FIGS. 5 and 6, the dispenser assembly 40 according to the second embodiment selectively opens and closes the housing 41 of the dispenser assembly 40 by slidably moving the dispenser door 42.

In detail, the dispenser door 42 slidably moves up and down to selectively shield the internal configuration of the housing 41. A handle 421 is protruded at the front surface of the dispenser door 42, such that the user can be gripped.

Figure 7:
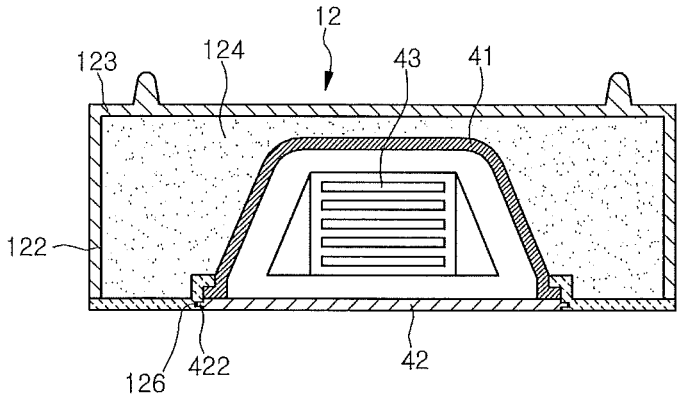
FIG. 7 is a transverse cross-sectional view taken along line II-II' of FIG. 6.

FIG. 7 is a transverse cross-sectional view taken along line II-II' of FIG. 6.

Referring to FIG. 7, a slide rib 422 is protruded at both sides of the dispenser door 42 and is extended by a length of the dispenser door 42. The door cover 122 (or the housing 41) is formed with a slide groove 126 that receives the slide rib 422. The dispenser door 42 is inserted into the rear surface of the door cover 122 while it descends. The front opening part of the housing 41 is gradually exposed to the outside. The front surface of the dispenser door 42 and the front surface of the door cover become coplanar in a state where the dispenser door 42 completely shields the housing 41.

Meanwhile, the dispenser door 42 can automatically move up and down. This configuration is shown in FIG. 8.

Figure 8:
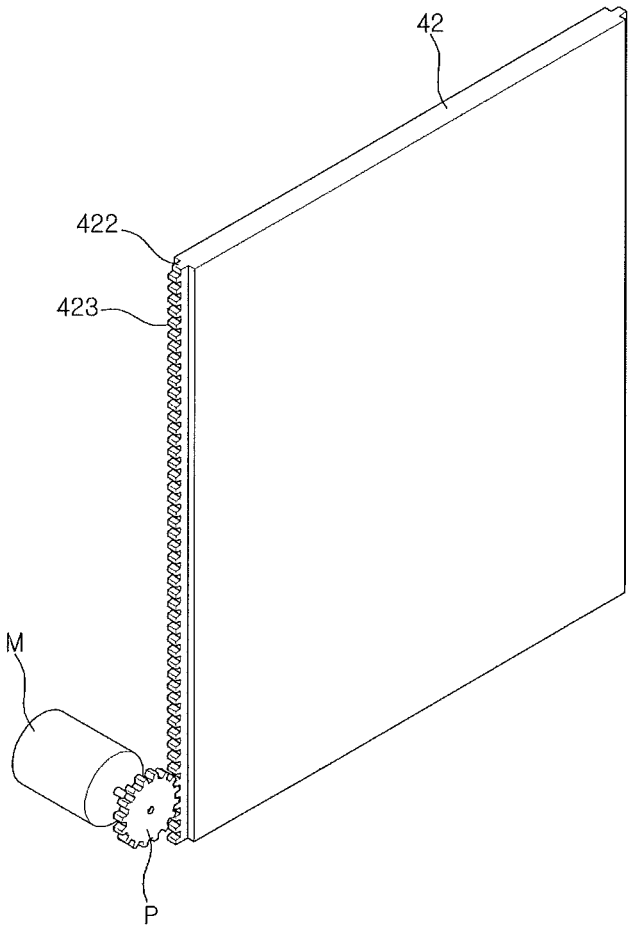
FIG. 8 is a perspective view showing a configuration that automatically elevates a dispenser door according to the second embodiment of the present invention.

FIG. 8 is a perspective view showing a configuration that automatically elevates a dispenser door according to the second embodiment of the present invention.

Referring to FIG. 8, the slide rib 422 of the dispenser door 42 is formed with the rack 423 and the rack 423 is engaged with a pinion P. The pinion P rotates forward and backward by a motor M. The motor M and the pinion P are mounted at the rear of the door cover 122, such that they are not exposed to the outside. A separate input button is provided at the button unit 22 of the display unit 20 and the motor M can rotate forward or backward by an operation of pressing the input button.

Figure 9:
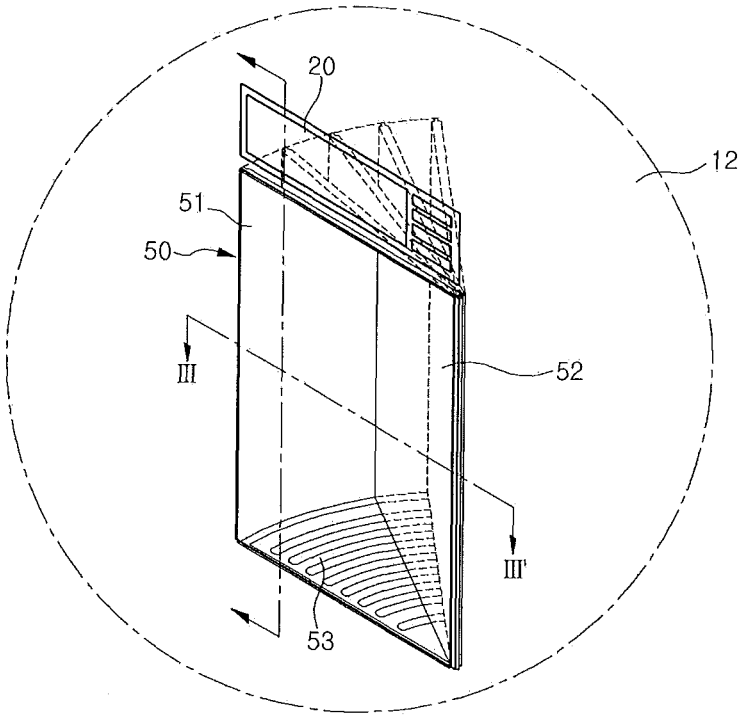
FIG. 9 is a perspective view showing a dispenser assembly of a refrigerator according to a third embodiment of the present invention.
Figure 10:
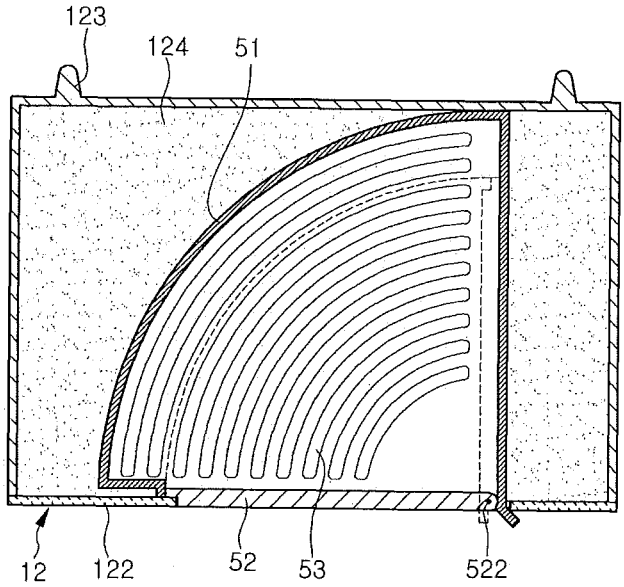
FIG. 10 is a transverse cross-sectional view taken along line III-III' of FIG. 9.
Figure 11:
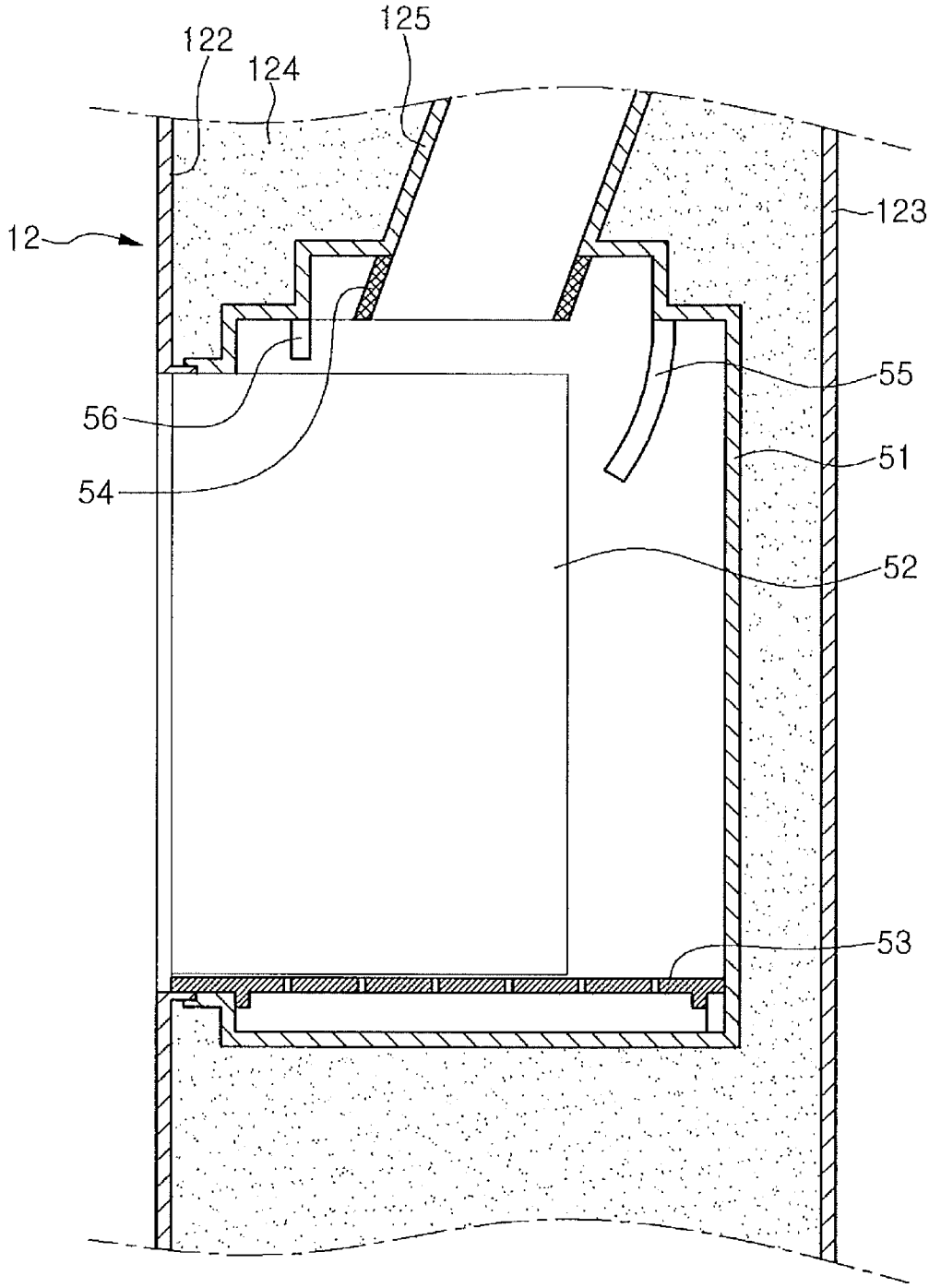
FIG. 11 is a longitudinal cross-sectional view taken along line IV-IV' of FIG. 9.

FIG. 9 is a perspective view showing a dispenser assembly of a refrigerator according to a third embodiment of the present invention, FIG. 10 is a transverse cross-sectional view taken along line of FIG. 9, and FIG. 11 is a longitudinal cross-sectional view taken along line IV-IV' of FIG. 9.

Referring to FIGS. 9 to 11, a dispenser assembly 50 of a refrigerator according to a third embodiment of the present invention includes a housing 51, a dispenser door 52 that selectively shields the front opening part of the housing 51, an ice chute 54, a faucet 56, a dispensing button 55, and a tray 53.

In detail, a discharge duct 125 is connected with the upper side of the ice chute 54 and the discharge duct 125 communicates with the ice making assembly (not shown) through the insulating layer 124 and the door liner 123.

In addition, the dispenser door 52 is provided to be rotatable in front and rear directions using a side edge as a rotating shaft 522. Herein, the dispenser door 52 rotates based on the longitudinal rotating shaft likewise the first embodiment. However, the fact that the dispenser door 52 rotates into the housing 51 is different from the first embodiment. The housing 51 has a transverse cross section structure in a fan shape unlike the first and second embodiments.

Further, the upper surface portion of the housing 51, which corresponds to a portion where the ice chute 54 and the faucet 56 are formed, is formed at a position more depressed to the upper side from a horizontal surface formed along the rotation trace of the upper surface portion of the dispenser door 52. Therefore, the interference phenomenon of the ice chute 54 and the faucet 56 is prevented while the dispenser door 52 rotates. In the same viewpoint, the dispensing button 55 is formed at a place that is out the outside from the rotation trace of the dispenser door 52.

In summary, the front opening part of the housing 51 is formed to have the same standard as the dispenser door 52 but the upper surface and rear surface of the housing 51 are formed to be larger than the rotation trace of the dispenser door 52. Therefore, the front surface of the dispenser door 52 and the front surface of the door cover 122 become coplanar in a state where the dispenser door 52 completely shields the housing 51.

As shown, when the front surface of the dispenser door 52 is pressed, the dispenser door 52 rotates backward based on the rotating shaft 522. The inside of the housing 51 is exposed to the outside while the dispenser door 52 rotates backward.

At this time, the rotating shaft 522 is provided with members such as the torsion spring or the hydraulic damper, such that when a force pushing the dispenser door 52 is removed, the dispenser door automatically rotates forward, the dispenser door 52 can shield the housing 51.

As another method, a locker structure according to the first embodiment is protruded the rear surface of the dispenser door 52 and the surface of the housing 51 contacting the locker structure may be formed with the locking hole. In other words, if the dispenser door 52 is pushed until the dispenser door 52 is closely attached to the front surface portion of the housing 51, the locker is inserted into the locking hole such that the housing 51 is maintained, in a state opened to the outside. In this state, the locker is separated from the locking hole by the slight pressing and releasing action onto the dispenser door 52 and the dispenser door 52 rotates forward by the repulsive force or the elastic force generated from the torsion spring or the hydraulic damper provided at the rotating shaft 522, making it possible to shield the housing 51.

As yet another method, a structure that the dispenser door 52 automatically rotates by power can be proposed. This example is shown in FIG. 12.

Figure 12:
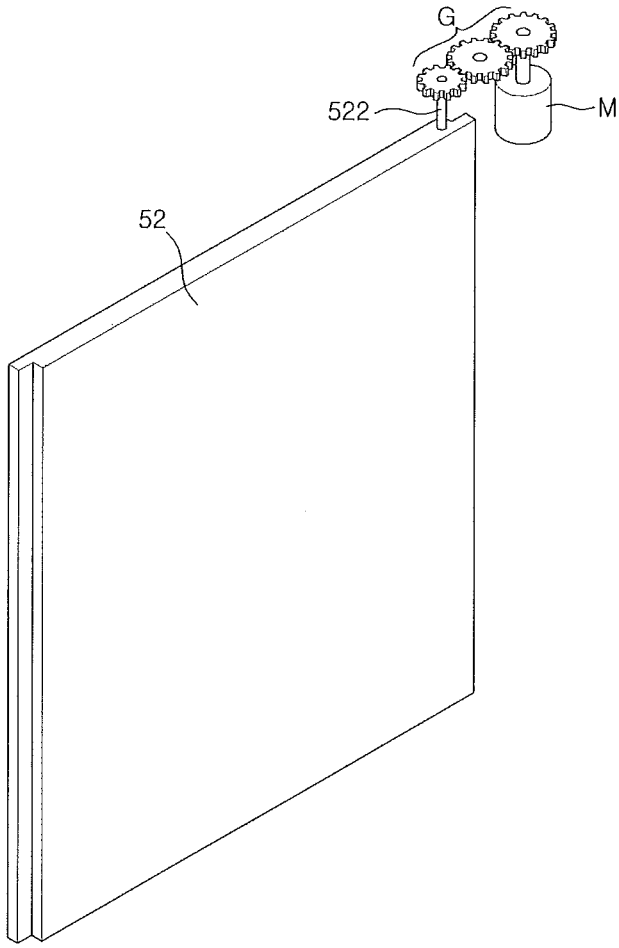
FIG. 12 is a perspective view showing an automatic rotating structure of a dispenser door according to the third embodiment.

FIG. 12 is a perspective view showing an automatic rotating structure of a dispenser door according to the third embodiment.

Referring to FIG. 12, a gear assembly G is connected with the rotating shaft 522 of the dispenser door 52 and the motor M is connected with the gear assembly G. The gear assembly G and the motor M are installed at the rear of the door cover 122, such that they are not exposed to the outside. The button part 22 of the display unit 20 is provided with a separate input button.

With this structure, if the user presses the input button, the motor M rotates to rotate the dispenser door 52 backward, thereby exposing the inside of the housing 51. In this state, the user positions the container such as a cup at the lower side of the ice chute 54 or the faucet 56, thereby receiving water or ice. Thereafter, if the input button is pressed again, the motor M rotates backward to rotate the dispenser 52 forward, thereby shielding the front opening part of the housing 51.

What is claimed is:

1. A refrigerator, comprising:

a storage chamber that is maintained at temperature lower than external temperature;

a storage chamber door that selectively opens and closes the storage chamber; and a dispenser assembly that is provided at the storage chamber door, wherein the dispenser assembly includes:

a housing that is depressed to receive a container and has an opening part formed at the front surface thereof;

a tray provided at a bottom surface of the housing and configured to at least one of support the container or store residual water;

a dispenser door that is rotatably provided at the front surface of the housing and is rotated into the housing to open the opening part, the dispenser door being configured to rotate with respect to a vertical axis passing through a side edge of the housing; and a dispensing part that is provided at a predetermined surface of the housing to dispense water or ice, wherein the tray is exposed based on the dispenser door being rotated into the housing to enable the container to receive the water or the ice.

2. The refrigerator according to claim 1, wherein the dispensing part includes at least one of an ice chute that guides ice dispensing and a faucet that dispenses water.

3. The refrigerator according to claim 1, further comprising:

an elastic member that is provided on a rotational shaft of the dispenser door and provides repulsive force to rotate the dispenser door forward in the state where the dispenser door is rotated backward; and a damper that is provided at the rotational shaft of the dispenser door and limits the rotational speed of the dispenser door.

4. The refrigerator according to claim 3, further comprising:

a locker that is protruded to a rear surface of the dispenser door; and a locking hole that is formed at the housing and has the locker inserted therein, wherein the locker is separated from the locking hole by a pressing and releasing action onto the dispenser door in the state where the locker is inserted into the locking hole.

5. The refrigerator according to claim 1, further comprising:

a button part that inputs an automatic rotation instruction of the dispenser door; and a driving unit that is connected to the rotational shaft of the dispenser door and provides a rotational force to the dispenser door.

6. The refrigerator according to claim 1, wherein the front surface of the dispenser door and the front surface of the storage chamber door become coplanar in a state where the dispenser door shields the opening part.

7. The refrigerator according to claim 2, wherein the housing is formed to have a space larger than a rotational trace of the dispenser door, and the dispensing part is provided at an outer side of the rotation trace of the dispenser door.

* * * * *